US011849818B2

(12) United States Patent
Bauer

(10) Patent No.: US 11,849,818 B2
(45) Date of Patent: Dec. 26, 2023

(54) METHOD OF CUSTOM DESIGNING A JEWELRY ARTICLE TO COMMEMORATE A SPECIAL DATE

(71) Applicant: Steven J. Bauer, Venetia, PA (US)

(72) Inventor: Steven J. Bauer, Venetia, PA (US)

( * ) Notice: Subject to any disclaimer, the term of this patent is extended or adjusted under 35 U.S.C. 154(b) by 0 days.

(21) Appl. No.: 18/320,973

(22) Filed: May 20, 2023

(65) Prior Publication Data

US 2023/0284755 A1 Sep. 14, 2023

Related U.S. Application Data

(63) Continuation-in-part of application No. 17/210,208, filed on Mar. 23, 2021, now abandoned.

(51) Int. Cl.
*A44C 27/00* (2006.01)

(52) U.S. Cl.
CPC ..... *A44C 27/00* (2013.01)

(58) Field of Classification Search
CPC ..... A44C 7/00; A44C 9/0053; A44C 5/0015; A44C 27/00
See application file for complete search history.

(56) References Cited

U.S. PATENT DOCUMENTS 2,322,461 A * 6/1943 Mariano ..... A44C 5/00 63/3
2003/0089128 A1* 5/2003 Minassian ..... A44C 11/007 63/4

FOREIGN PATENT DOCUMENTS

DE 102008052095 A1 * 4/2010 ..... A44C 7/00

* cited by examiner

*Primary Examiner* — Jack W Lavinder
(74) *Attorney, Agent, or Firm* — ACKER WOOD IP LAW LLC; Gwen R. Acker Wood

(57) ABSTRACT

The present invention provides a method of commemorating at least one special date for an individual with a customized jewelry design. The method comprises selecting at least one day, from numbers 1 through 31, and at least one month, from numbers 1 through 12, that the individual wishes to commemorate; placing at least one first design element which corresponds to the at least one selected day on a base element, said base element divided into sixty visible or invisible segments to represent a clock face with a top point on the clock face representing noon or midnight and referred to as a zero point, wherein the placement of the at least one first design element represents at least one minute hand of the clock and placing at least one second design element which corresponds to the at least one selected month on the base element, wherein the placement of the at least one second design element represents at least one hour hand of the clock. The customized jewelry may include, without limitation, pendants, earrings, bracelets or rings.

18 Claims, 18 Drawing Sheets

METHOD OF CUSTOM DESIGNING A JEWELRY ARTICLE TO COMMEMORATE A SPECIAL DATE

CROSS REFERENCE TO RELATED APPLICATIONS

This application is a continuation-in-part of U.S. application Ser. No. 17/210,208, filed Mar. 23, 2021, which is incorporated herein by reference in its entirety.

FIELD OF THE INVENTION

The present invention relates to jewelry designs and, more particularly, to methods for customizing jewelry such as pendants, earrings, bracelets and rings to commemorate a specific calendar date by transposing a particular date into time on the customized jewelry.

BACKGROUND OF THE INVENTION

Jewelry design is one of civilization's earliest forms of decoration, dating back at least 7,000 years to the oldest known societies in Mesopotamia and Egypt. Beyond being worn for personal adornment, jewelry bought as a gift can possess meaning and sentimental value that far transcends its monetary value, as it can represent love and commitment to a relationship, a rite of passage in a person's life, or be passed down as an ancestral legacy from one generation to the next. Customization of jewelry as a gift to someone to commemorate a specific day, time or event has always been popular, such as engraving special words or names, or buying charms for a charm bracelet. The present invention provides an even more unique and memorable way to customize a particular piece of jewelry in order to commemorate a special day or a special time in one's life.

SUMMARY OF THE INVENTION

The present invention fulfills this need by providing a unique customized jewelry design in which one or more specific calendar dates (i.e., month and day) are transposed onto a base element as if the one or more dates were shown as time on a clock. One or more specific times also may be positioned on the base element. The dates and times positioned on the base element may be chosen to commemorate a special occasion, such as a birthday, the day and time of a child's birth, anniversary date, graduation date or any other occasion or event that contains meaning.

In one aspect of the invention, there is provided a customized jewelry design comprised of a base element that can be divided into sixty segments, which segments may be visible or invisible, so as to represent a clock; and one or more sets of two design elements. The first design element of the one or more sets is positioned on the base element at one of the sixty segments and represents an hour hand of a clock. The second design element of the one or more sets also is positioned on the base element at one of the sixty segments and represents a minute hand of a clock. The placement of each of the one or more sets of design elements may represent one or more specific times, or the one or more specific times may represent one or more calendar days, i.e., the number of the month and the number of the day which has been transposed into one or more specific times on the clock.

In another aspect of the invention, there is provided a method of commemorating at least one special date for an individual with a customized jewelry design. The method comprises selecting at least one day, from numbers 1 through 31, and at least one month, from numbers 1 through 12, that an individual wishes to commemorate; placing at least one first design element which corresponds to the at least one selected day on a base element, the base element divided into sixty segments, which segments may be visible or invisible, to represent a clock face with a top point on the clock face representing noon or midnight and referred to a zero point, wherein the placement of the at least one first design elements represents at least one minute hand of the clock; and placing at least one second design element which corresponds to the at least one selected month on the base element, wherein the placement of the at least one second design element represents at least one hour hand of the clock.

The placement of the at least one first design element representing the at least one minute hand of the clock is determined by degrees of rotation from the zero point, the degrees of rotation for the at least one minute hand calculated by the following equation: minute hand design element degrees of rotation from zero point=(day number)×6 degrees.

The placement of the at least one second design element representing the at least one hour hand of the clock is determined by degrees of rotation from the zero point, the degrees of rotation for the at least one hour hand calculated by the following equation: hour hand design element degrees of rotation from zero point=(month number×30 degrees)+(day number×0.5 degrees).

In an embodiment, the first design element and the second design element comprise two or more ornamental stones adjacent to one another.

In an embodiment, the base element can have a front surface, a back surface, an outer surface, and an inner surface, and the first and second design elements are positioned on the front surface of the base element. In this embodiment, the base element is any piece of jewelry including, without limitation, a pendant or a pair of earrings.

In another embodiment of the invention, the base element can have a front surface, a back surface, an outer surface, and an inner surface, and the first and second design elements are positioned on the outer surface of the base element. In this embodiment, the base element may be a piece of jewelry including, without limitation, a bracelet or a ring.

BRIEF DESCRIPTION OF THE DRAWINGS

A fuller understanding of the invention can be gained from the following description when read in conjunction with the accompanying figures, where like reference numerals refer to identical or functionally similar elements throughout the separate views, which illustrate some, but not the only and exclusive, examples of embodiments of the invention and, as such, the figures disclosed herein are to be considered illustrative rather than limiting. In the drawings.

DETAILED DESCRIPTION OF THE INVENTION

Figure 1:
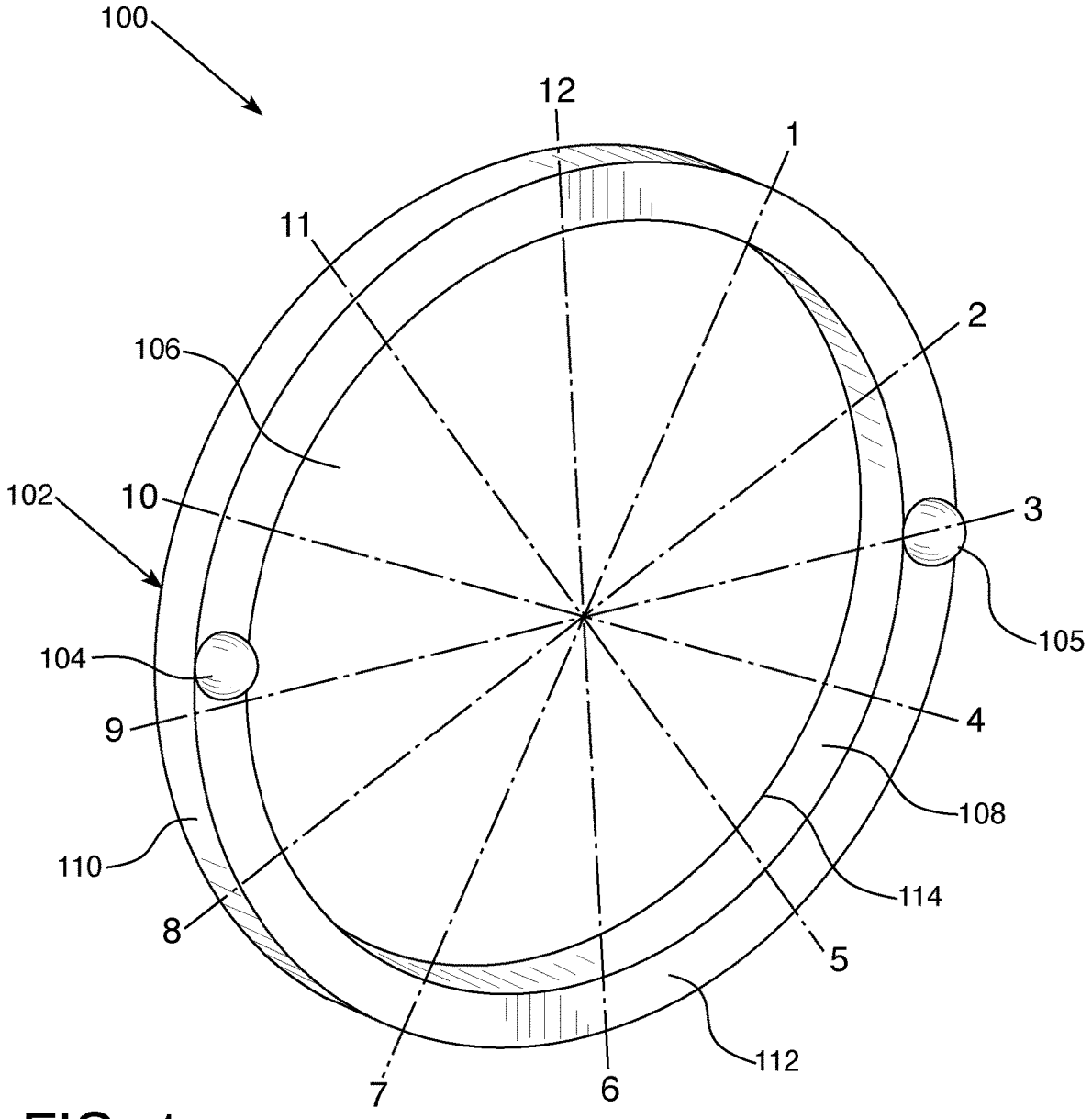
FIG. 1 is a perspective view of the base element, showing one set of design elements positioned on the front surface of the base element to indicate the time "9:15", or to indicate the calendar date September 15, in accordance with an embodiment of the invention.
Figure 2:
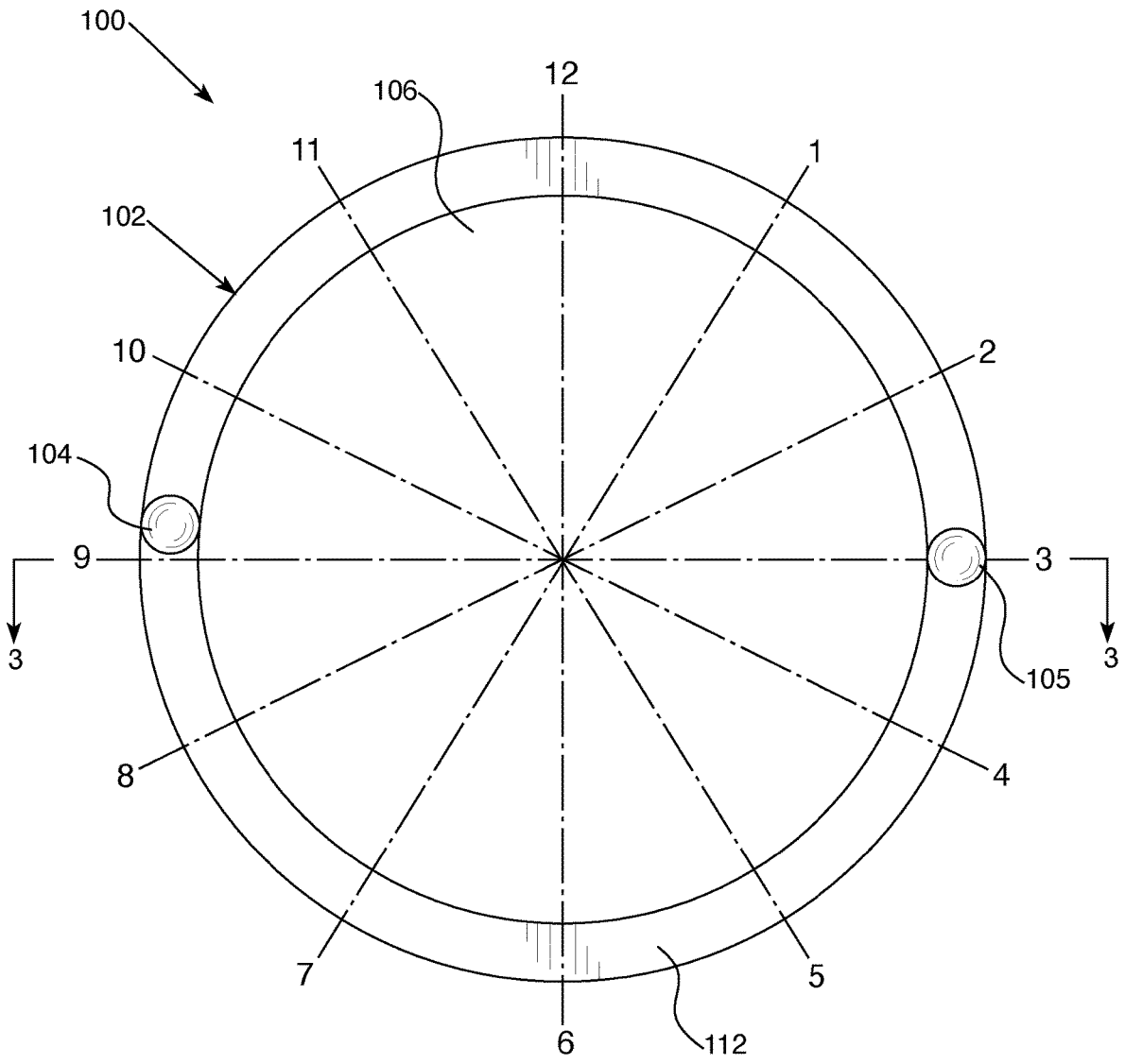
FIG. 2 is a front view of the base element and the one set of design elements of FIG. 1, in accordance with an embodiment of the invention.
Figure 3:
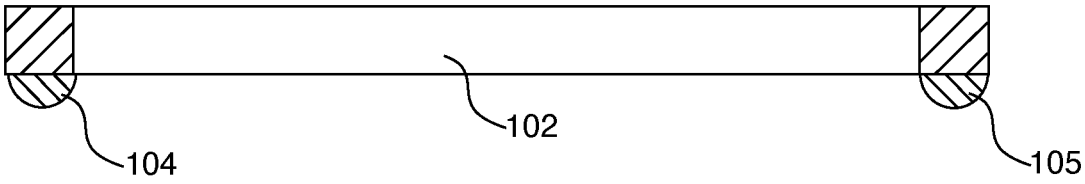
FIG. 3 is a cross-section of the front view of FIG. 2 taken at 3-3, in accordance with an embodiment of the invention.
Figure 4:
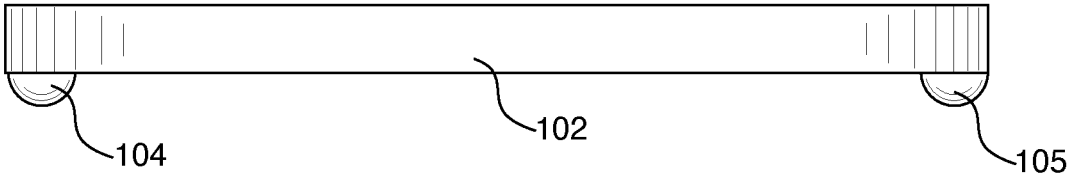
FIG. 4 is a top plan view of FIG. 2, in accordance with an embodiment of the invention.
Figure 5:
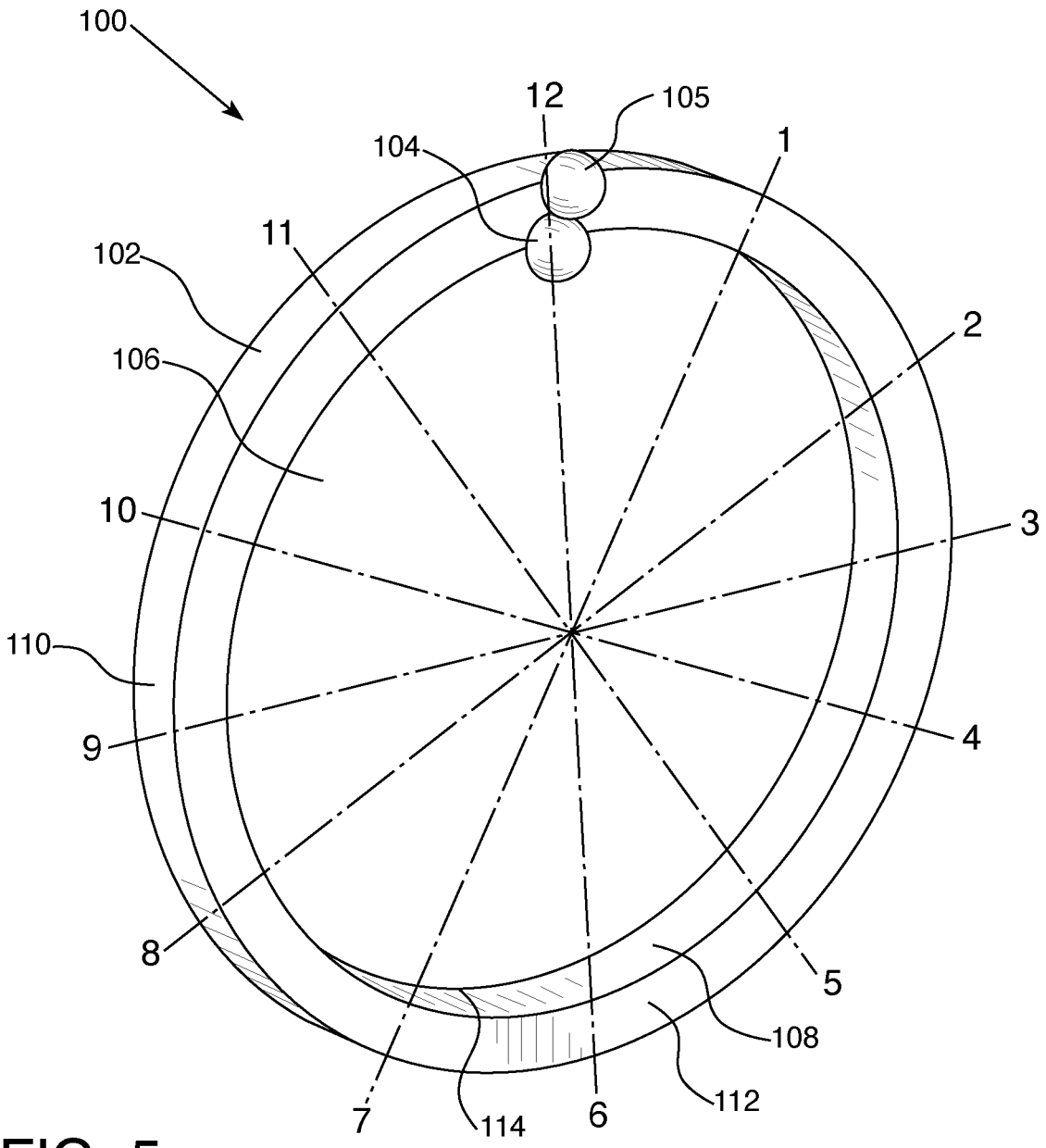
FIG. 5 is a perspective view of the base element, showing one set of design elements positioned on the front surface of the base element to indicate the time "12:01", or to indicate the calendar date December 1, in accordance with an embodiment of the invention.
Figure 6:
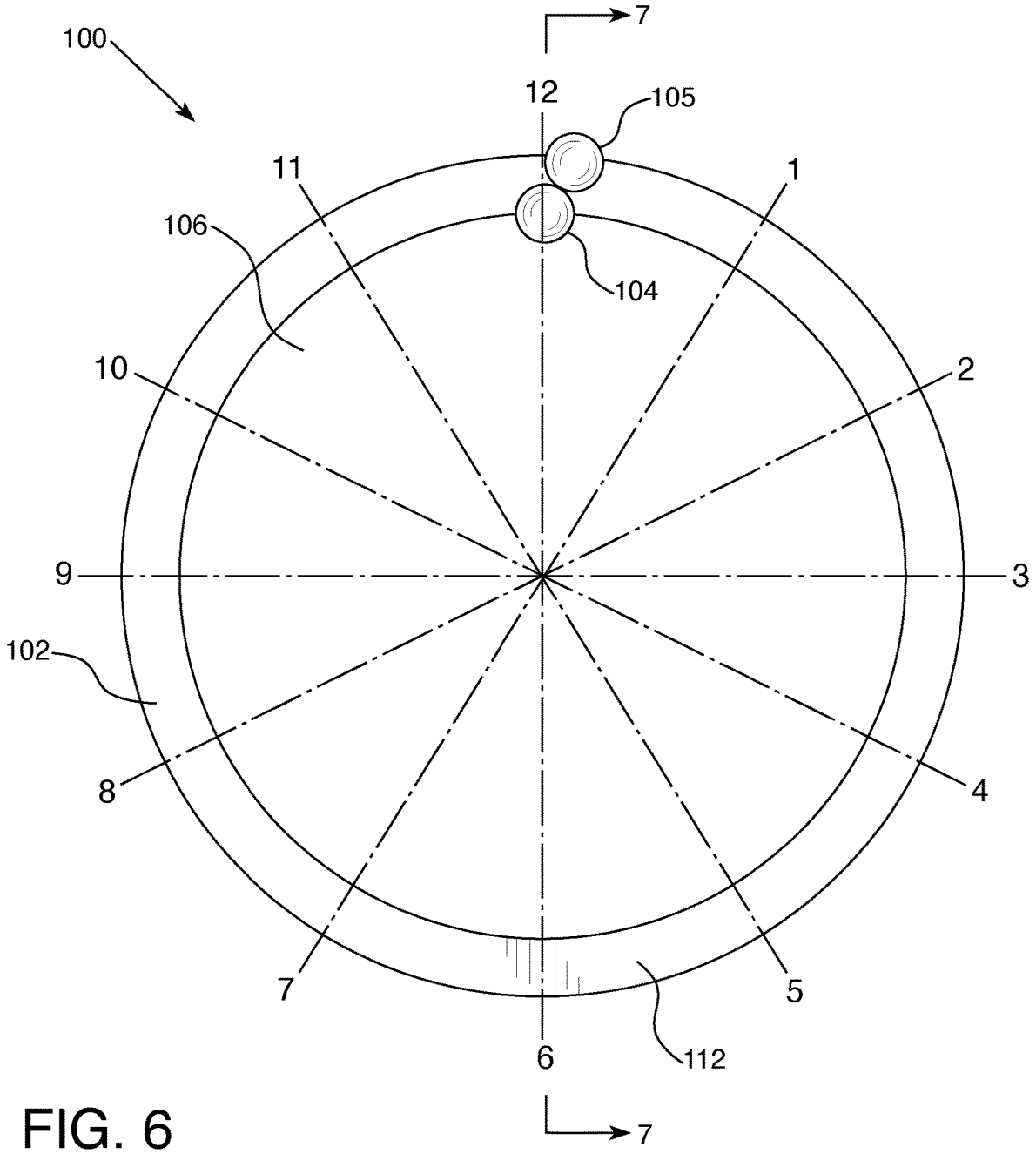
FIG. 6 is a front view of the base element and the one set of design elements of FIG. 5, in accordance with an embodiment of the invention.
Figure 7:
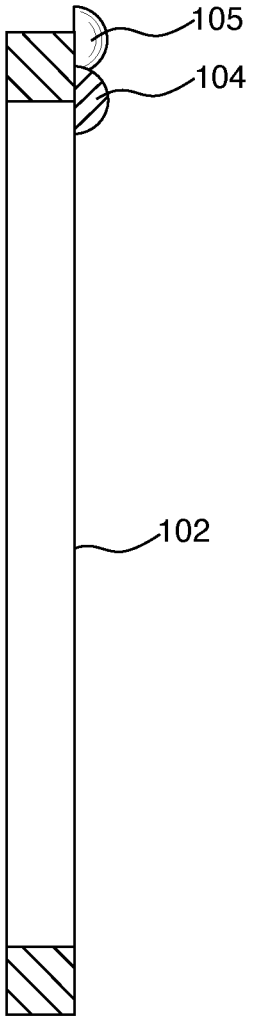
FIG. 7 is a cross-section of the front view of FIG. 6 taken at 7-7, in accordance with an embodiment of the invention.
Figure 8:
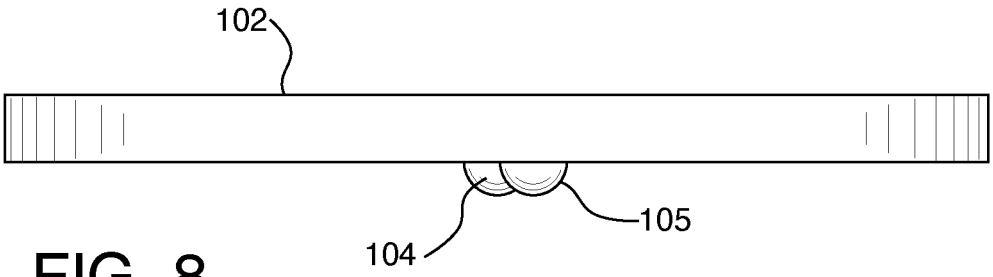
FIG. 8 is a top plan view of FIG. 6, in accordance with an embodiment of the invention.

As used herein, the terms "transpose" or "transposition" are defined as transferring from one context to another context, such as transferring numbers that relate to a specific calendar date to numbers that relate to a specific time on a clock.

As used herein, the term "design element" is defined as any ornamental stone, semi-precious stone, precious stone, mineral, jewel, natural or artificial gold, silver, platinum, copper, nickel, titanium, palladium rhodium, tungsten, iridium, cobalt, ruthenium, niobium, osmium, zirconium, rhenium, wood, plastic, other natural or artificial materials, and combinations thereof capable of being positioned on a piece of jewelry.

A complete understanding of the present invention will be obtained from the following detailed description taken in connection with the accompanying drawing figures, which is intended to be illustrative only, as numerous modifications and variations therein will be apparent to those skilled in the art.

Referring now to FIGS. 1-11, in one non-limiting embodiment of the invention, there is provided a customized jewelry design 100 comprised of a base element 102 having a front surface 112, a back surface 114, an inner surface 108, an outer surface 110, and an opening 106 defined by the inner surface 108; and one or more sets of two design elements, in which the first design element (shown as 104 or 104') of the one or more sets is positioned on the front surface of the base element 102 to represent an hour hand of a clock, and the second design element (shown as 105 or 105') of the one or more sets is positioned on the front surface of the base element to represent a minute hand of a clock. Placement of the one or more sets of design elements represents one or more specific calendar dates, one or more specific times, or any combination of specific calendar dates or specific times. With dates or times that occupy substantially the same position on a clock, the design elements are positioned adjacent to one another in a stacked or staggered configuration.

In this embodiment, which may include pieces of jewelry such as, without limitation, pendants and earrings, each surface 112, 114, 108, 110 of the base element 102 is planar and is positioned at right angles from its adjacent surface, with all of the surfaces being substantially the same width. However, the invention contemplates base elements with decorative shapes that are circular, ovoid, elliptical, rectangular, square, or multi-sided. Further, the base element may be a solid that is irregular-shaped, a closed loop, an open loop, a flat plane, or three-dimensional.

In order to accurately position the hour hand design element 104 and the minute hand design element 105 on the base element 102, the front surface 112 of the base element 102 is divided into sixty visible or invisible segments (shown on the figures in five minute increments) which correspond to sixty minutes on a clock.

As shown in FIGS. 1-4, in one non-limiting example of this embodiment, the one set of two design elements 104, 105 are positioned separate from one another on the front surface 112 of the base element 102 at positions corresponding to the time "9:15." This placement can correspond to the calendar date "September 15" by transposing the number 9 for the 9th month and the number 15 for the $15^{th}$ day on the base element 102 if one wants to commemorate this specific date, or it can correspond to the time "9:15" if one wants to commemorate this specific time. Similar to the way the location of the minute hand on a clock impacts the location of the hour hand, the placement of the hour hand, i.e., month, needs to be fine-tuned depending on the day, i.e., minutes, that is selected. In this example, when the minute hand is located at a position which represents 15 minutes, the hour hand is located at a position which represents nine hours but is dispositioned closer to the position which represents 10 hours.

As shown in FIGS. 5-8, in another non-limiting example of this embodiment, the one set of two design elements 104, 105 are positioned adjacent to one another on the front surface 112 of the base element 102 at positions corresponding to the time "12:01." This placement can correspond to the calendar date December 1 by transposing the number 12 for the $12^{th}$ month and the number 1 for the $1^{st}$ day on the base element 102 if one wants to commemorate this specific date, or it can correspond to the time "12:01" if one wants to commemorate this specific time. In this example, when the minute hand is located at a position which represents one minute, the hour hand is located at a position which represents 12 hours but is dispositioned very slightly closer to the position which represents one hour.

Figure 9:
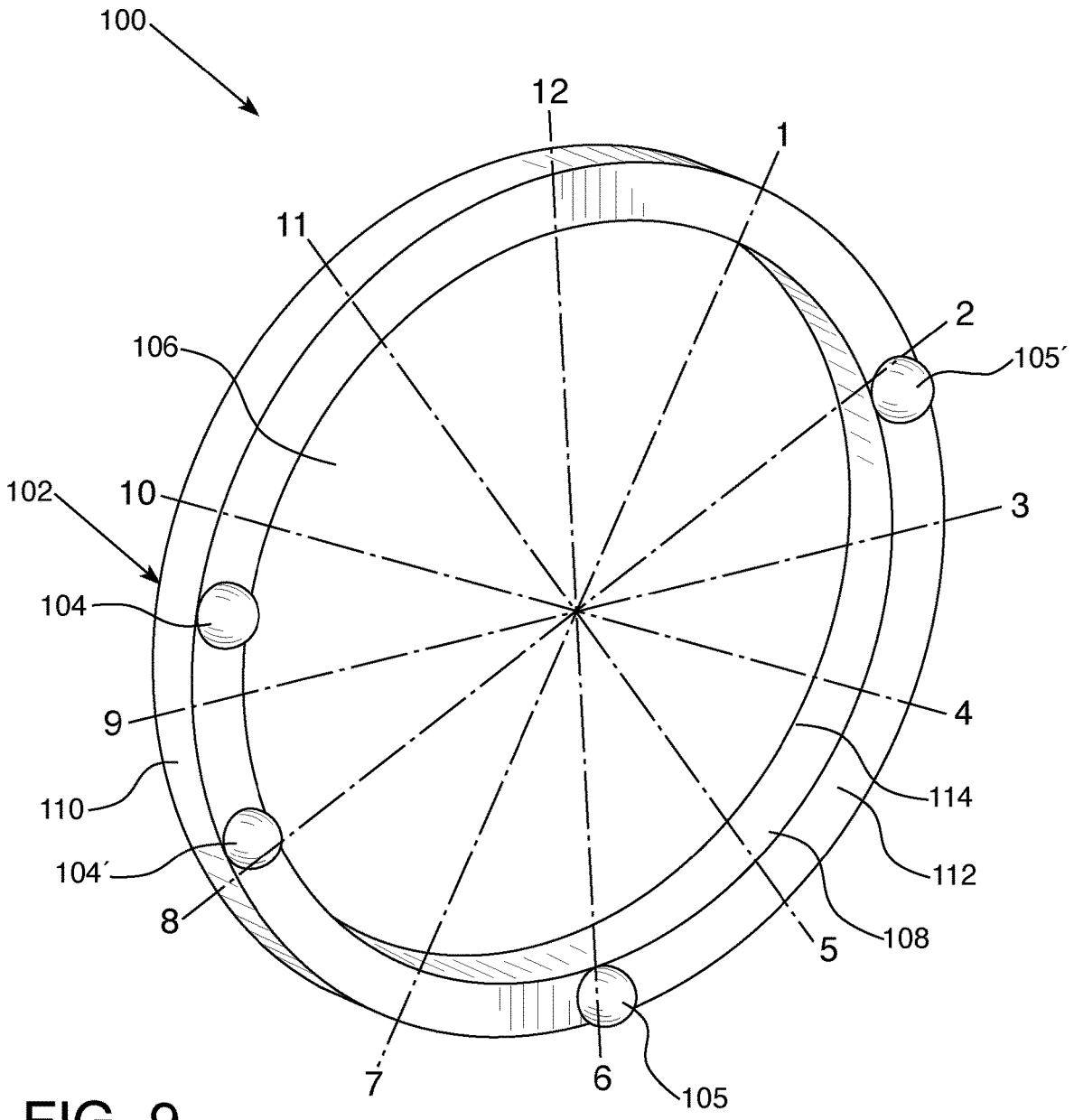
FIG. 9 is a perspective view of the base element, showing two sets of design elements positioned on the front surface of the base element to indicate the times "9:30" and "8:11," or to indicate the calendar dates September 30 and August 11, respectively, or a combination of a time and a calendar date, in accordance with an embodiment of the invention.

As shown in FIG. 9, in another non-limiting example of this embodiment, one set of two design elements 104, 105 and a second set of two design elements 104', 105' each are positioned separate from one another on the front surface 112 of the base element 102 at positions corresponding to the times "9:30" and "8:11," respectively. These placements can correspond to the calendar dates "September 30" and "August 11" by transposing the numbers 9 and 8 for the $9^{th}$ month and the $8^{th}$ month, respectively, and the numbers 30 and 11 for the $30^{th}$ day and the $11^{th}$ day, respectively, on the base element 102 if one wants to commemorate these specific dates, it can correspond to the times "9:30" and "8:11" if one wants to commemorate these specific times, or one set of design elements can correspond to a specific calendar date and the other set of design elements can correspond to a specific time. In this example, in the first set of design elements, when the minute hand is located at a position which represents 30 minutes, the hour hand is located at a position which represents nine hours but is dispositioned closer to the position which represents 10 hours. In the second set of design elements, when the minute hand is located at a position which represents 11 minutes, the hour hand is located at a position which represents eight hours but is dispositioned somewhat closer to the position which represents 9 hours.

Figure 10:
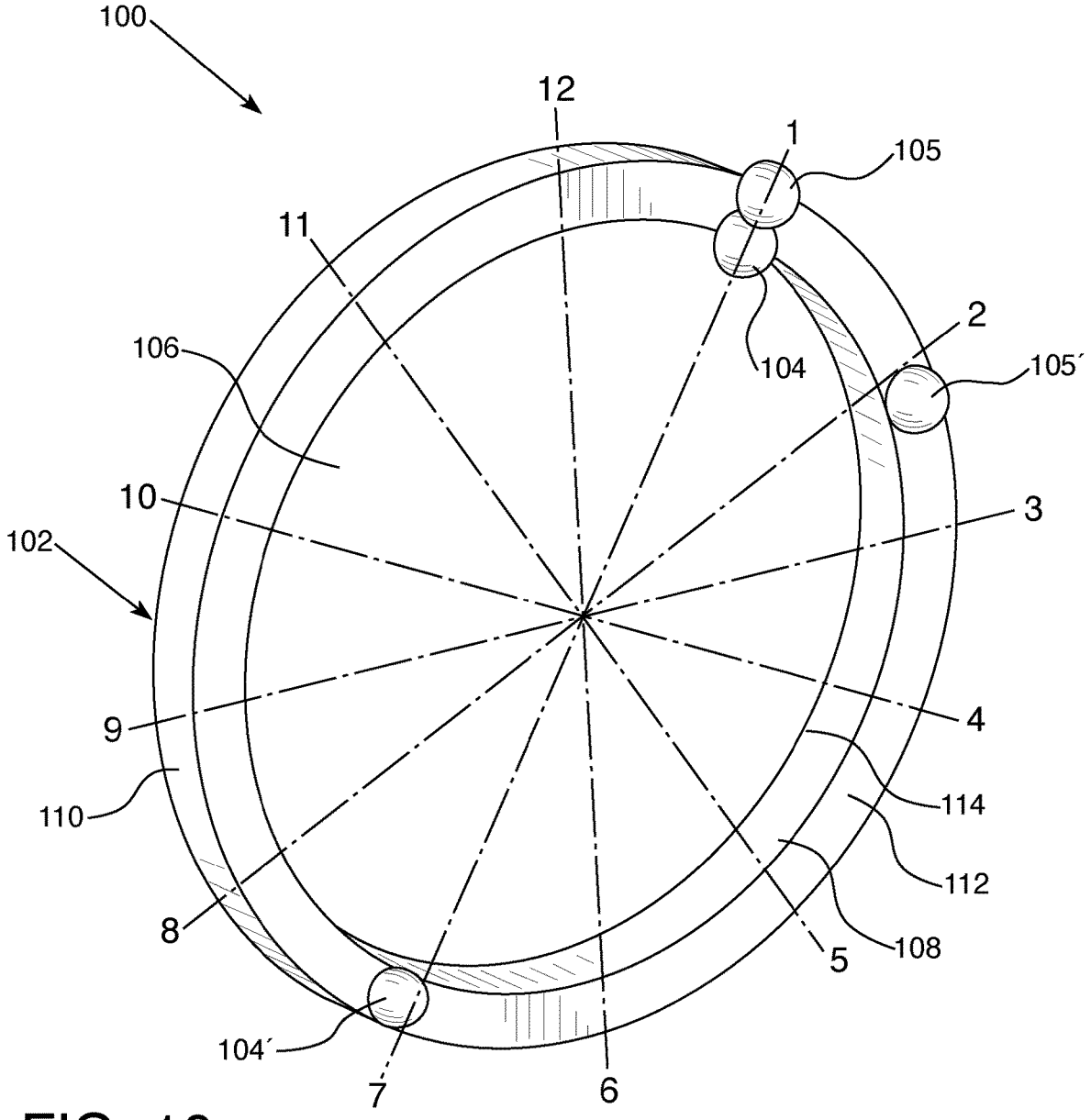
FIG. 10 is a perspective view of the base element, showing two sets of design elements positioned on the front surface of the base element to indicate the times "1:05" and "7:11," or to indicate the calendar dates January 5 and July 11, respectively, or a combination of a time and a calendar date, in accordance with an embodiment of the invention.

As shown in FIG. 10, in another non-limiting example of this embodiment, one set of two design elements 104, 105 are positioned adjacent to one another and a second set of two design elements 104', 105' are positioned separate from one another on the front surface 112 of the base element 102 at positions corresponding to the times "1:05" and "7:11," respectively. These placements can correspond to the calendar dates "January 5" and "July 11" by transposing the numbers 1 and 7 for the $1^{st}$ month and the $7^{th}$ month, respectively, and the numbers 5 and 11 for the $5^{th}$ day and the $11^{th}$ day, respectively, on the base element 102 if one wants to commemorate these specific dates, it can correspond to the times "1:05" and "7:11" if one wants to commemorate these specific times, or one set of design elements can correspond to a specific calendar date and the other set of design elements can correspond to a specific time. In this example, in the first set of two design elements, when the minute hand is located at a position which represents 5 minutes, the hour hand is located at a position which represents one hour and the two design elements are located at the same position. In the second set of design elements, when the minute hand is located at a position which represents 11 minutes, the hour hand is located at a position which represents seven hours but is dispositioned somewhat closer to the position which represents 8 hours.

Figure 11:
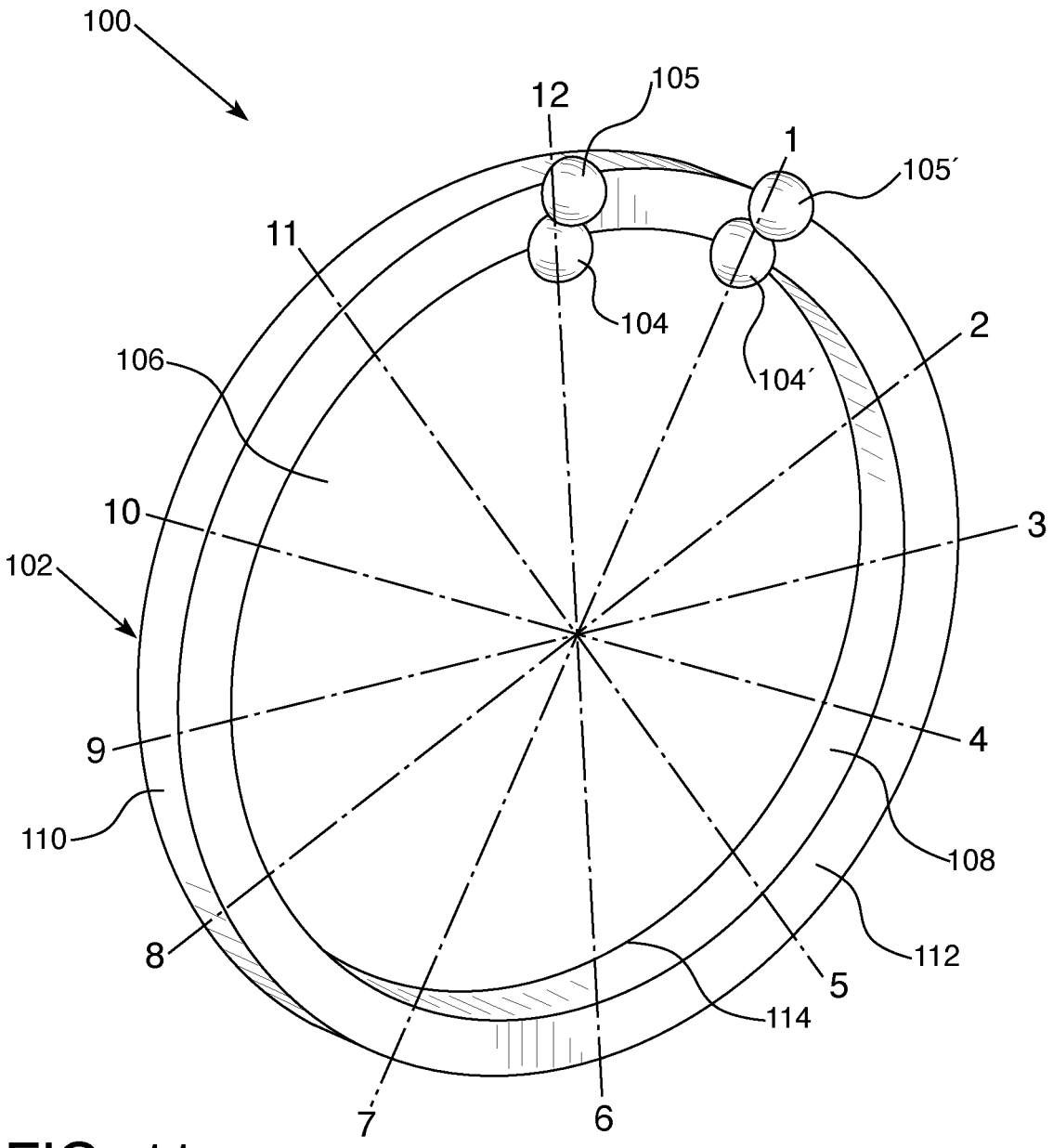
FIG. 11 is a perspective view of the base element, showing two sets of design elements positioned on the front surface of the base element to indicate the times "12:01" and "1:05," or to indicate the calendar dates December 1 and January 5, respectively, or a combination of a time and a calendar date, in accordance with an embodiment of the invention.

As shown in FIG. 11, in another non-limiting example of this embodiment, one set of two design elements 104, 105 are positioned adjacent to one another and a second set of two design elements 104', 105' are positioned adjacent to one another on the front surface 112 of the base element 102 at positions corresponding to the times "12:01" and "1:05," respectively. These placements can correspond to the calendar dates "December 1" and "January 5" by transposing the numbers 12 and 1 for the $12^{th}$ month and the $1^{st}$ month, respectively, and the numbers 1 and 5 for the $1^{st}$ day and the $5^{th}$ day, respectively, on the base element 102 if one wants to commemorate these specific dates, it can correspond to the times "12:01" and "1:05" if one wants to commemorate these specific times, or one set of design elements can correspond to a specific calendar date and the other set of design elements can correspond to a specific time. In this example, in the first set of two design elements, when the minute hand is located at a position which represents one minute, the hour hand is located at a position which represents 12 hours and the two design elements essentially are located at the same position. In the second set of design elements, when the minute hand is located at a position which represents 5 minutes, the hour hand is located at a position which represents one hour and the two design elements are located at the same position.

In another non-limiting embodiment of the invention, as shown in FIGS. 12-17, there is provided a customized jewelry design 100 comprised of a base element 102 having a front surface 112, a back surface 114, an inner surface 108, an outer surface 110, and an opening 106 defined by the inner surface 108; and one or more sets of two design elements, in which the first design element (shown as 104 or 104') of the one or more sets is positioned on the outer surface 110 of the base element 102 to represent an hour hand of a clock, and the second design element (shown as 105 or 105') of the one or more sets is positioned on the outer surface 110 of the base element 102 to represent a minute hand of a clock.

In this embodiment, which may include pieces of jewelry such as, without limitation, bracelets and rings, the outer surface 110 and the inner surface 108 of the base element 102 is rounded and the front surface 112 and the back surface 114 of the base element 102 is planar. The width of the outer 110 and inner 108 surfaces can be about 3 to about 6 times the width of the front 112 and the back 114 surfaces. However, the invention contemplates base elements having decorative shapes that are circular, ovoid, elliptical, rectangular, square, or multi-sided.

In addition, as in the first embodiment, placement of the one or more sets of design elements on the outer surface 110 of the base element 102 may represent one or more specific calendar dates, one or more specific times, or any combination of specific calendar dates or specific times; the outer surface 110 of the base element 102 is divided into sixty visible or invisible segments (shown on the figures in five minute increments) corresponding to sixty minutes on a clock; and with dates or times that occupy substantially the same position on a clock, the design elements are positioned adjacent to one another in a stacked or staggered configuration.

Figure 12:
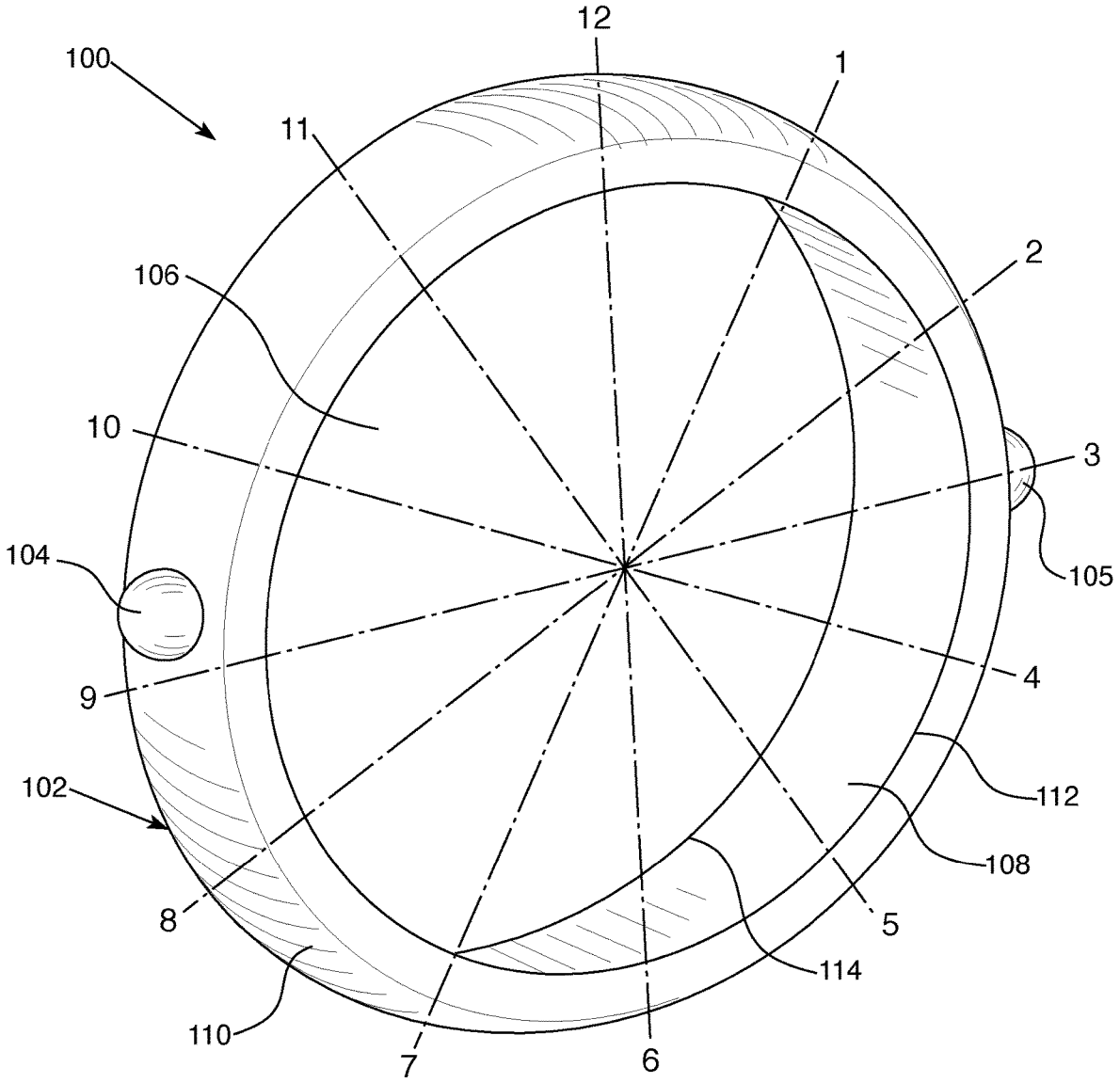
FIG. 12 is a perspective view of the base element, showing one set of design elements positioned on the outer surface of the base element to indicate the time "9:15", or to indicate the calendar date September 15, in accordance with an embodiment of the invention.
Figure 13:
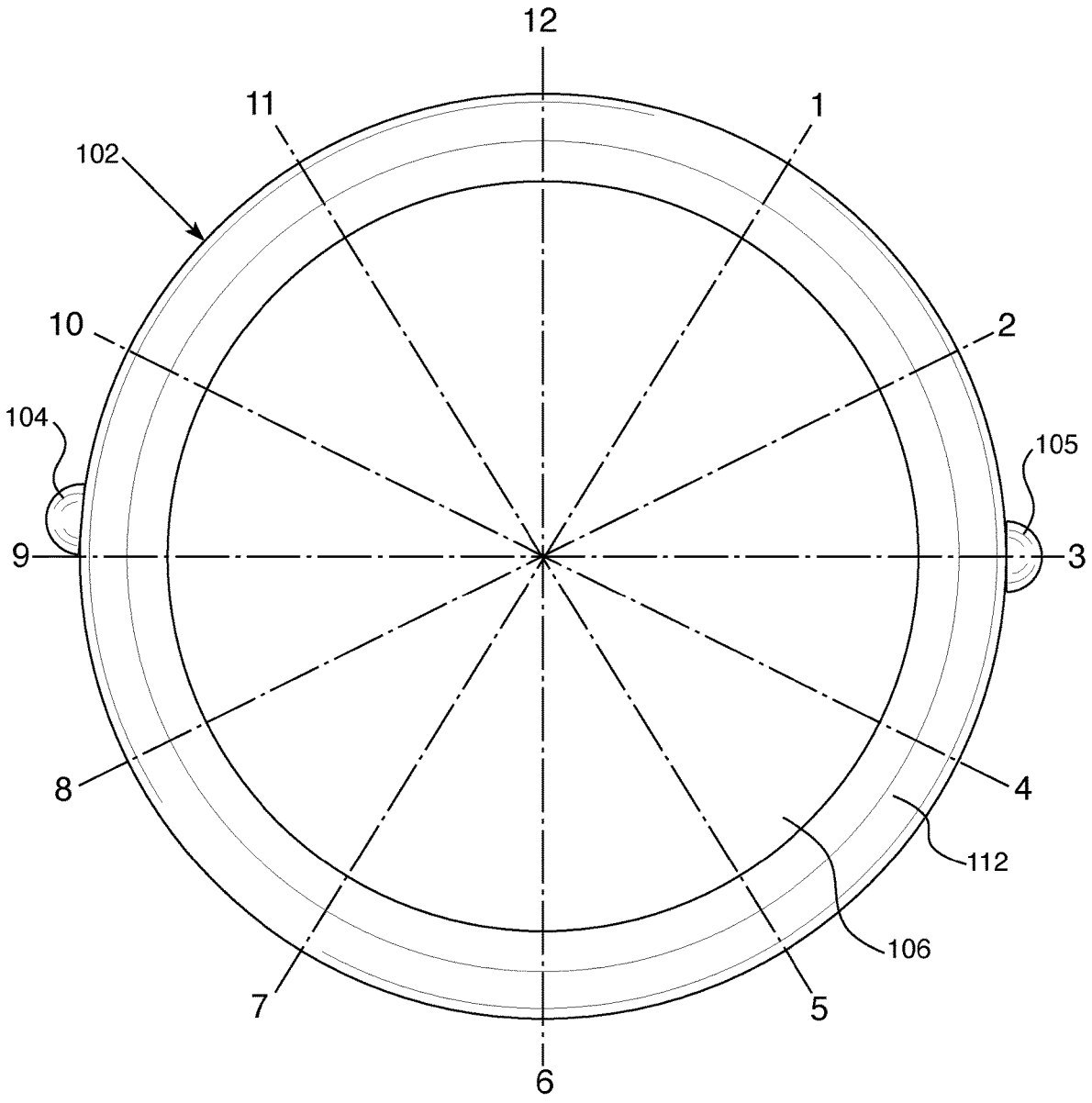
FIG. 13 is a front view of the base element and the one set of design elements of FIG. 12, in accordance with an embodiment of the invention.

As shown in FIGS. 12 and 13, in one non-limiting example of this embodiment, one set of two design elements 104, 105 are positioned separate from one another on the outer surface 110 of the base element 102 at positions corresponding to the time "9:15." This placement can correspond to the calendar date "September 15" by transposing the number 9 for the $9^{th}$ month and the number 15 for the $15^{th}$ day on the base element 102 if one wants to commemorate this specific date, or it can correspond to the time "9:15" if one wants to commemorate this specific time. In this example, when the minute hand is located at a position which represents 15 minutes, the hour hand is located at a position which represents nine hours but is dispositioned closer to the position which represents 10 hours.

Figure 14:
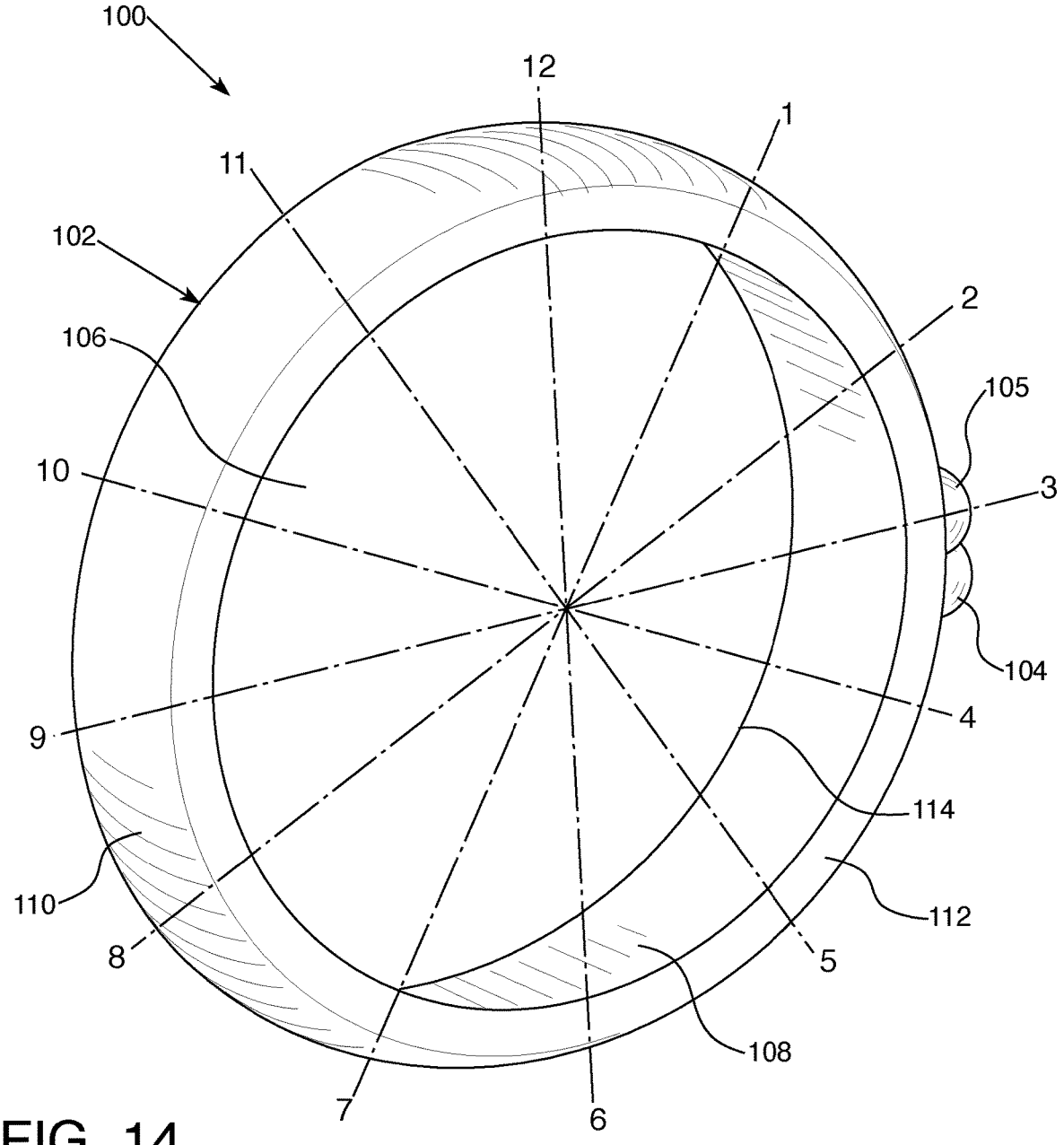
FIG. 14 is a perspective view of the base element, showing one set of design elements positioned on the outer surface of the base element to indicate the time "3:15", or to indicate the calendar date March 15, in accordance with an embodiment of the invention.
Figure 15:
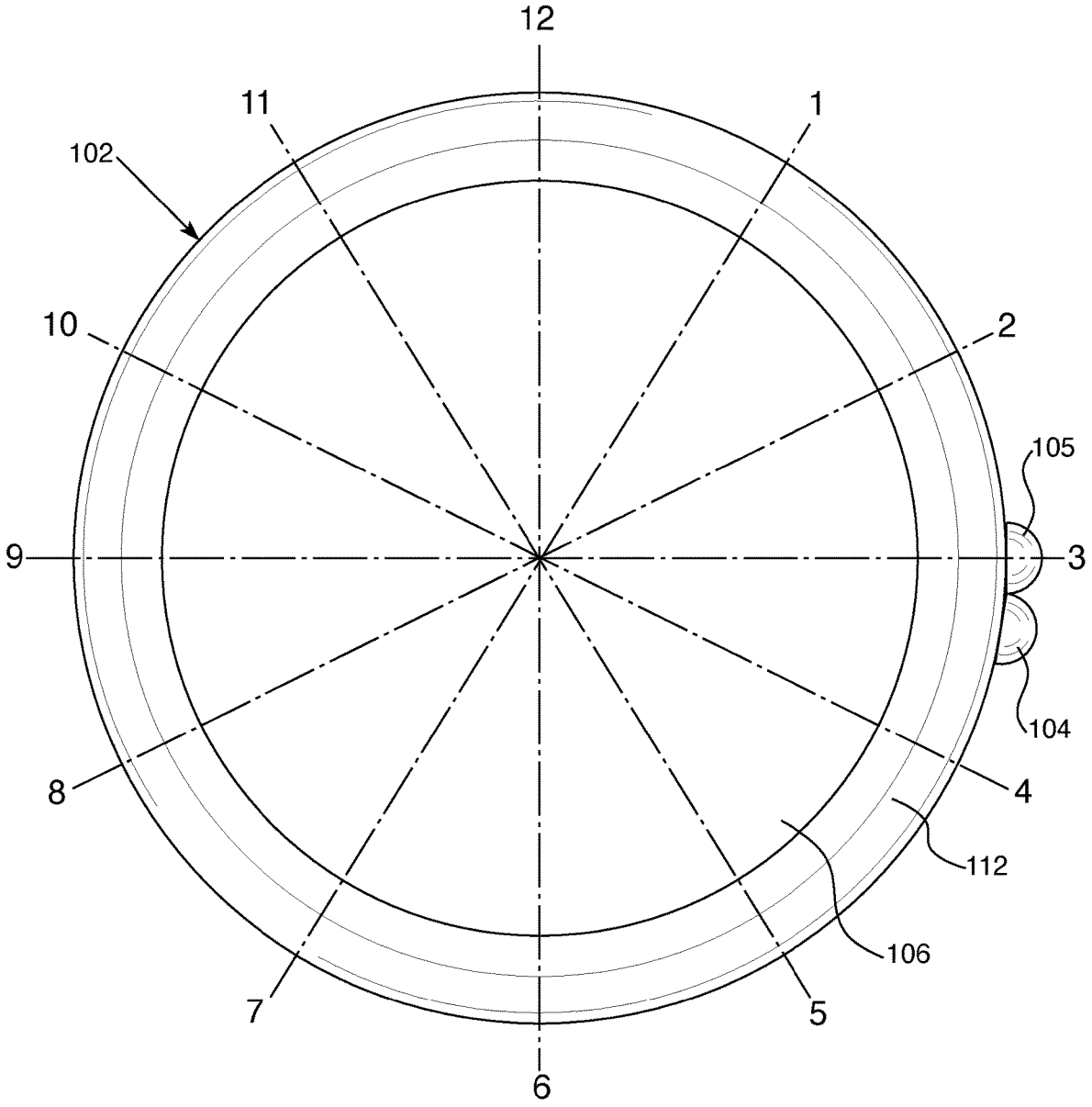
FIG. 15 is a front view of the base element and the one set of design elements of FIG. 14, in accordance with an embodiment of the invention.

As shown in FIGS. 14 and 15, in another non-limiting example of this embodiment, one set of two design elements 104, 105, corresponding to the hour hand and the minute hand, respectively, are positioned adjacent to one another on the outer surface 110 of the base element 102 at positions corresponding to the time "3:15." This placement can correspond to the calendar date "March 15" by transposing the number 3 for the $3^{rd}$ month and the number 15 for the $15^{th}$ day on the base element 102 if one wants to commemorate this specific date, or it can correspond to the time "3:15" if one wants to commemorate this specific time. In this example, when the minute hand is located at a position which represents 15 minutes, the hour hand is located at a position which represents three hours and the two design elements are located at the same position.

Figure 16:
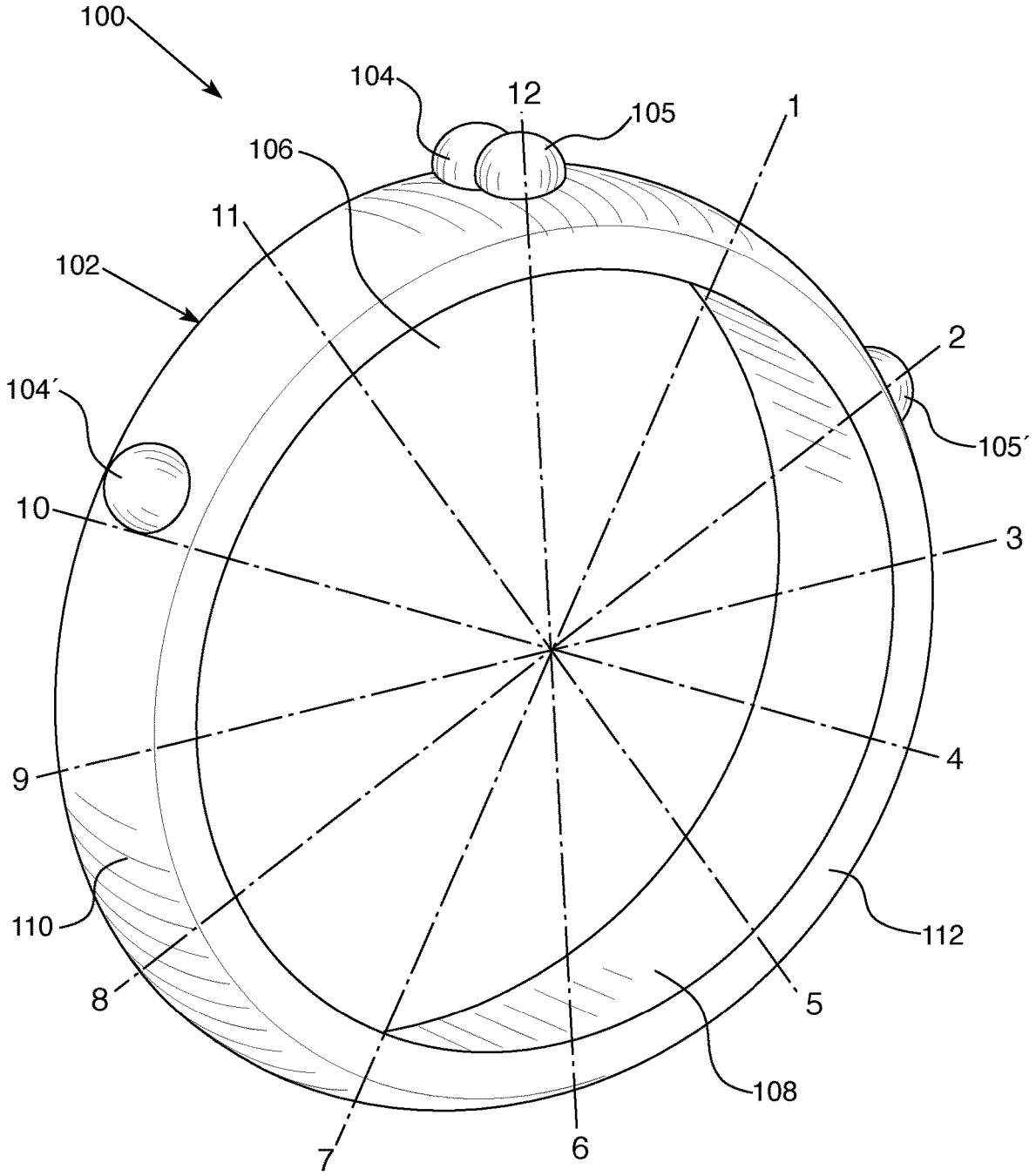
FIG. 16 is a perspective view of the base element, showing two sets of design elements positioned on the outer surface of the base element to indicate the times "10:10" and "12:01", or to indicate the calendar dates October 10 and December 1, respectively, or a combination of a time and a calendar date, in accordance with an embodiment of the invention.
Figure 17:
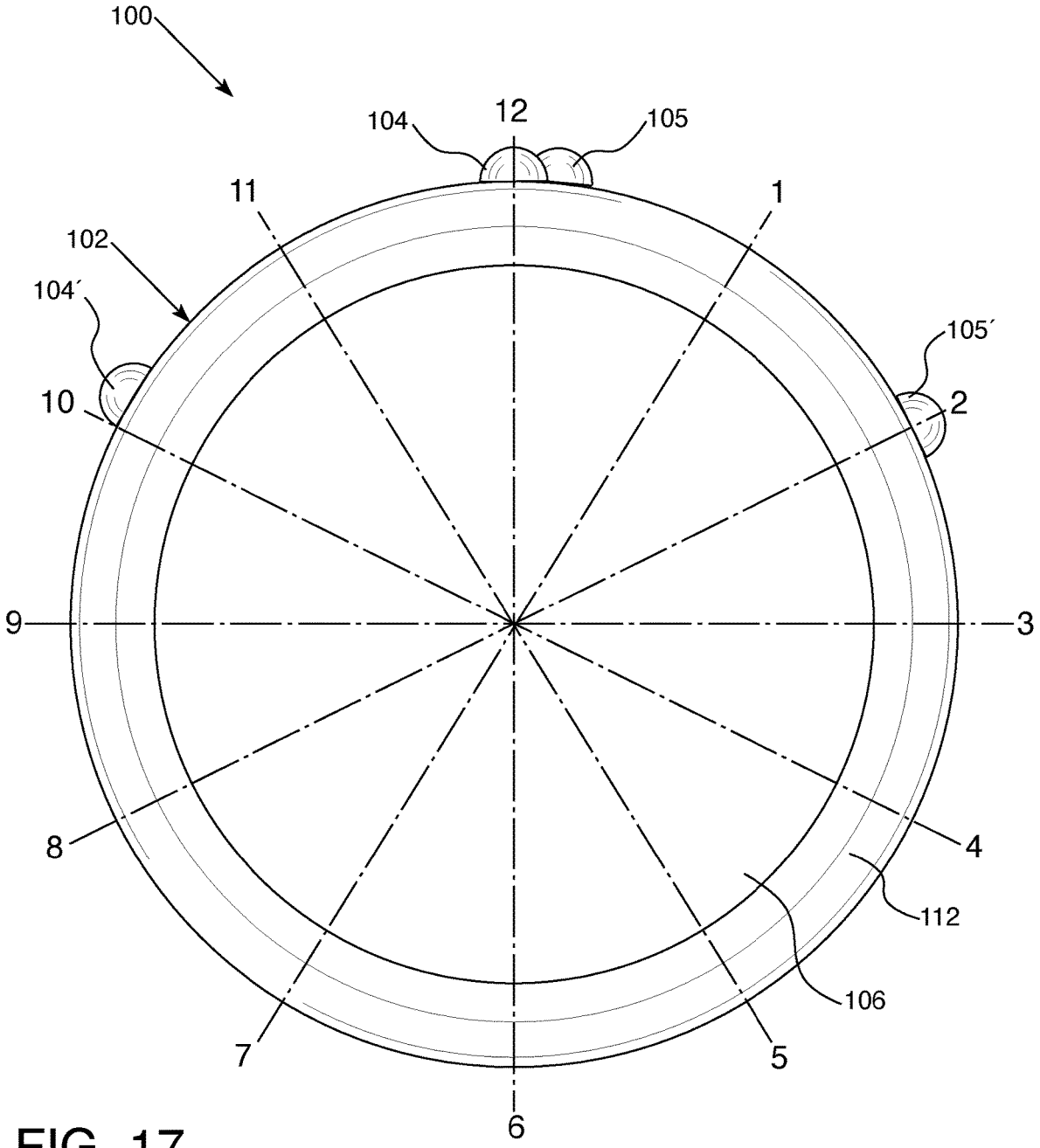
FIG. 17 is a front view of the base element and the two sets of design elements of FIG. 16, in accordance with an embodiment of the invention.

As shown in FIGS. 16 and 17, in another non-limiting example of this embodiment, one set of two design elements 104, 105 are positioned adjacent to one another and a second set of two design elements 104', 105' are positioned separate from one another on the outer surface 110 of the base element 102 at positions corresponding to the times "12:01" and "10:10," respectively. These placements can correspond to the calendar dates "December 1" and "October 10" by transposing the numbers 12 and 10 for the $12^{th}$ month and the $10^{th}$ month, respectively, and the numbers 1 and 10 for the $1^{st}$ day and the $10^{th}$ day, respectively, on the base element 102 if one wants to commemorate these specific dates, it can correspond to the times "12:01" and "10:10" if one wants to commemorate these specific times, or one set of design elements can correspond to a specific calendar date and the other set of design elements can correspond to a specific time. In this example, in the first set of two design elements, when the minute hand is located at a position which represents one minute, the hour hand is located at a position which represents 12 hours and the two design elements are located at the same position. In the second set of design elements, when the minute hand is located at a position which represents 10 minutes, the hour hand is located at a position which represents ten hours but is dispositioned somewhat closer to the position which represents 11 hours.

Figure 18:
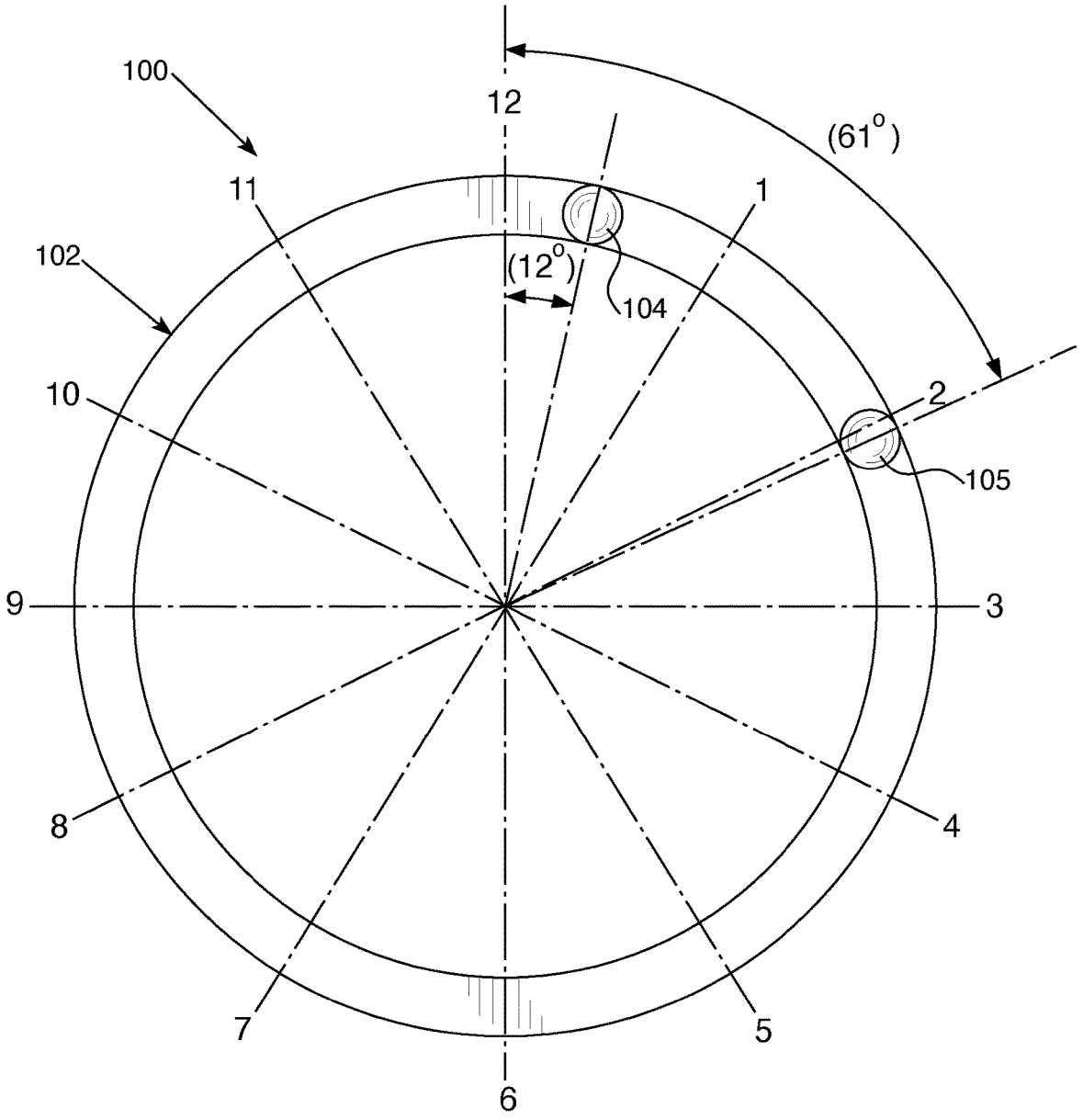
FIG. 18 is a front view of the base element showing placement of ornamental stones to commemorate the date February 2, i.e., a 2/2 layout, on the outer surface of the base element.
Figure 19:
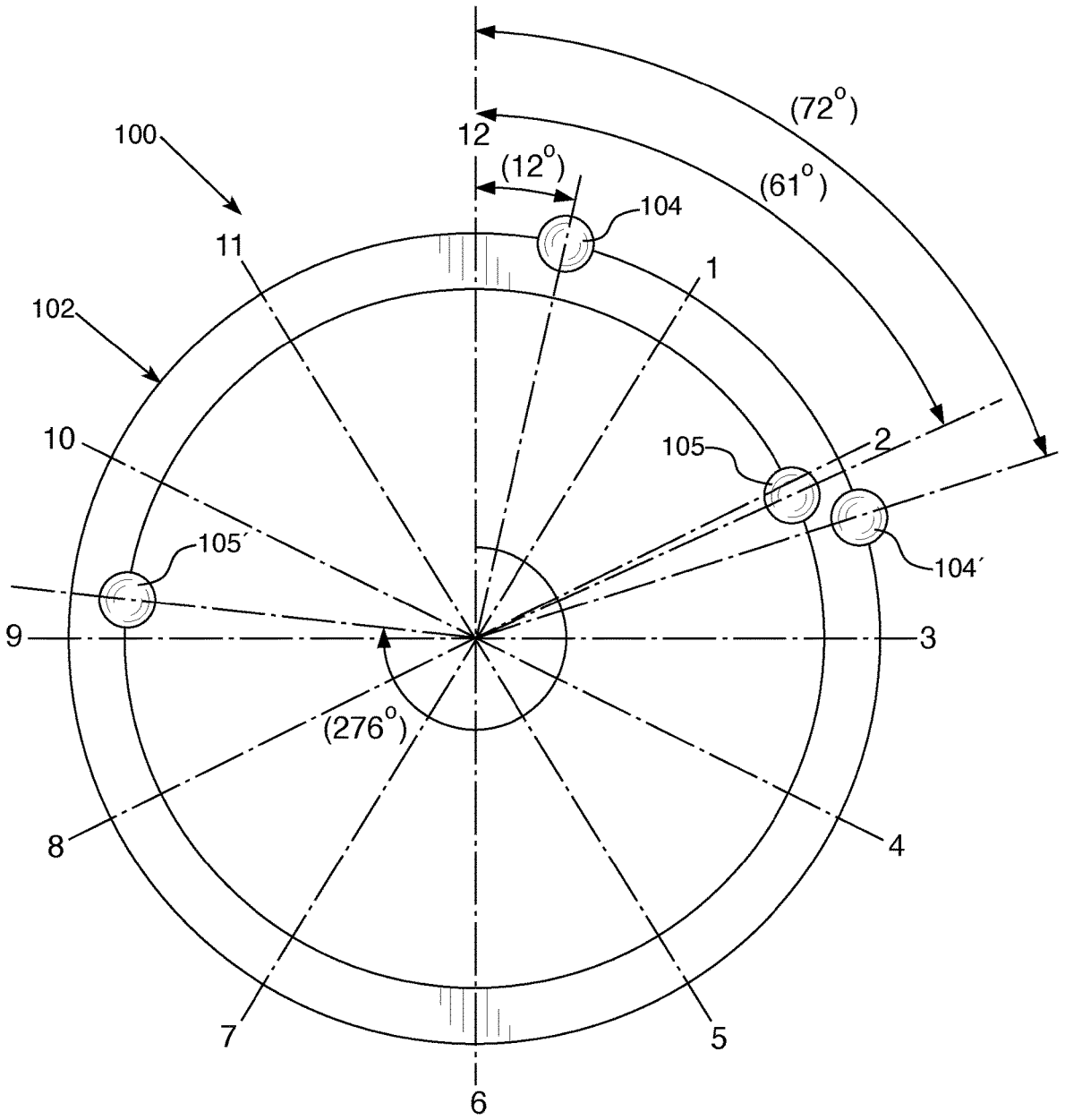
FIG. 19 is a front view of the base element showing placement of the ornamental stones to commemorate the date February 2 as shown in FIG. 18 and placement of two ornamental stones to commemorate the date September 12, i.e., a combined 2/2 and 9/12 layout, on the outer surface of the base element.
Figure 20:
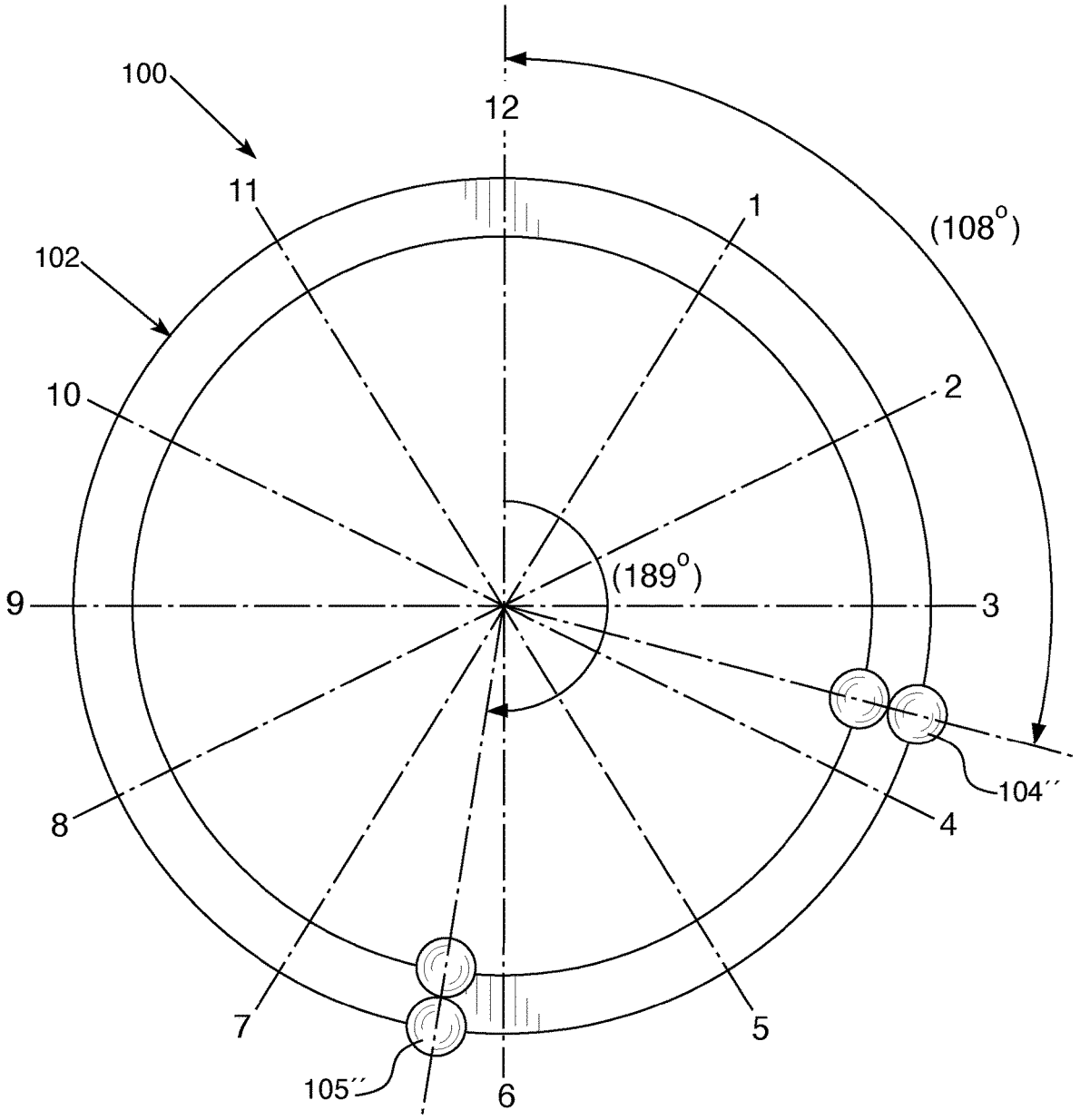
FIG. 20 is a front view of the base element showing placement of two ornamental stones for the day and two ornamental stones for the month to commemorate a date twice or two birthdays (i.e., for twins), or to commemorate an equivalent date and time, June 18 and 6:18, on the outer surface of the base element.

FIGS. 18, 19 and 20 each illustrate non-limiting examples of a method for accurately positioning the one or more sets of two design elements on the base element when custom designing a commemorative jewelry design of the invention.

As shown in FIG. 18, in one non-limiting example, to commemorate the date February 2 or the time 2:02, one set of design elements, such as amethysts, are positioned on the base element 102 divided into sixty visible or invisible segments representing a clock face, in which the number "12" on the clock is referred to as the "zero point" or "zero degrees" on the clock and represents either noon or midnight. To determine the placement of the first design element 104, i.e., the minute hand, which represents Day 2, one places the first design element 104 where the number "2" would be on a clock. Alternatively, the following equation may be used to calculate the "degrees of rotation" from the zero point where the first design element is positioned:

minute hand degrees of rotation from zero point=day number×6 degrees.

Putting in the number "2" for the day in this equation results in the following degrees of rotation: 2×6 degrees=12 degrees. One also may use Table 1 to calculate the degrees of rotation from the vertical zero point for each of the 31 days that may be commemorated:

TABLE 1

| Location of Day/Minute Hand (degrees from vertical) | |
|---|---|
| 1 | 6 |
| 2 | 12 |
| 3 | 18 |
| 4 | 24 |
| 5 | 30 |
| 6 | 36 |
| 7 | 42 |
| 8 | 48 |
| 9 | 54 |
| 10 | 60 |
| 11 | 66 |
| 12 | 72 |
| 13 | 78 |
| 14 | 84 |
| 15 | 90 |
| 16 | 96 |
| 17 | 102 |
| 18 | 108 |
| 19 | 114 |
| 20 | 120 |
| 21 | 126 |
| 22 | 132 |
| 23 | 138 |
| 24 | 144 |
| 25 | 150 |
| 26 | 156 |
| 27 | 162 |
| 28 | 168 |
| 29 | 174 |
| 30 | 180 |
| 31 | 186 |

To determine the placement of the second design element, i.e., the hour hand, one places the second design element in 30 degree intervals around the face of the base element depending on the month. However, as discussed above, the placement of the hour hand needs to be fine-tuned depending on the day, i.e., minutes, that is selected. Thus, the following equation may be used to calculate the "degrees of rotation" from the zero point where the second design element is positioned:

hour hand degrees of rotation from zero point= (month number×30 degrees)+(day number×0.5 degrees).

Putting in the number "2" for the month of February in this equation results in the following degrees of rotation: (2×30 degrees)+(2×0.5 degrees)=61 degrees.

In addition, one may also use Table 2 to calculate the degrees of rotation from the zero point for each of the 12 months that may be commemorated by adding the "Degrees from Vertical for the Month/Hours (in this example: 60) to "Add'l Degrees from Vert" for the Selected Day/Min (in this example: 1.0). Thus, the second design element, or hour hand, is positioned 61 degrees from the zero point.

TABLE 2

| Month/ Hour | Degrees from Vertical |
|---|---|
| 1 | 30 |
| 2 | 60 |
| 3 | 90 |
| 4 | 120 |
| 5 | 160 |
| 6 | 180 |
| 7 | 210 |
| 8 | 240 |
| 9 | 270 |
| 10 | 300 |
| 11 | 330 |
| 12 | 0 (380) |
| **Selected Day/Month** | **Add'l Degrees from Vert** |
| 1 | 0.5 |
| 2 | 1.0 |
| 3 | 1.5 |
| 4 | 2.0 |
| 5 | 2.5 |
| 6 | 3.0 |
| 7 | 3.5 |
| 8 | 4.0 |
| 9 | 4.5 |
| 10 | 5.0 |
| 11 | 5.5 |
| 12 | 6.0 |
| 13 | 6.5 |
| 14 | 7.0 |
| 15 | 7.5 |
| 16 | 8.0 |
| 17 | 8.5 |
| 18 | 9.0 |
| 19 | 9.5 |
| 20 | 10.0 |
| 21 | 10.5 |
| 22 | 11.0 |
| 23 | 11.5 |
| 24 | 12.0 |
| 25 | 12.5 |
| 26 | 13.0 |
| 27 | 13.5 |
| 28 | 14.0 |
| 29 | 14.5 |
| 30 | 15.0 |
| 31 | 15.5 |

Referring now to FIG. 19, in another non-limiting example, to commemorate two dates, February 2 and September 12 or the times 2:02 and 9:12, two sets of design elements, such as amethyst and sapphire, shown on the base element 102 as 2:02 and 9:12, are positioned on the base element 102. The first set of two design elements are positioned on the base element as described in Example 1.

For the September 12 date, the placement of the first design element 104', i.e., the minute hand, is positioned on the base element 102 where the number "12" would be on a clock (shown in Table 1 or calculated as 72 degrees rotation from the zero point: 12×6 degrees=72 degrees). The placement of the second design element, which is the hour hand and represents September, or month 9, is calculated by using the equation provided above:

hour hand degrees of rotation from zero point= (month number×30 degrees)+(day number×0.5 degrees).

Putting in the number "9" for the month and "12" for the day results in the following degrees of rotation: (9×30 degrees)+(12×0.5 degrees)=276 degrees. One also may use Table 2 to calculate the degrees of rotation from the zero point. Thus, the second design element, or hour hand, is positioned 276 degrees from the zero point.

In another embodiment of the invention, one may customize a jewelry design using one or more of the same design elements for the minute/day hand and one or more of the same design elements for the hour/month hand. As shown in FIG. 20, in another non-limiting example, to commemorate the date June 18, (i.e., 6/18), shown on the base element 102 as 6:18, two design elements 104," such as twin pearls, are used for the minute hand, and two design elements 105," such as alexandrite, are used for the hour hand.

In this example, the placement of the first design elements 104", i.e., the minute hand, on the base element 102 is positioned where the number "18" would be on a clock (shown in Table 1 or calculated as 108 degrees rotation from the zero point: 18×6 degrees=108 degrees). The placement of the second design elements 105", i.e., the hour hand, on the base element 102, is calculated by using the equation provided above:

hour hand degrees of rotation from zero point= (month number×30 degrees)+(day number×0.5 degrees).

Putting in the number "6" for the month and "18" for the day results in the following degrees of rotation: (6×30 degrees)+(18×0.5 degrees)=189 degrees. One also may use Table 2 to calculate the degrees of rotation from the zero point. Thus, the second design elements, or hour hand, is positioned 189 degrees from the zero point.

In the invention, by convention, when two or more dates or times are positioned on the base element 102, such as shown in FIGS. 19 and 20, the design element representing the hour/month is shifted inwardly with respect to the design element representing the minute/day. In addition, when two design elements are used for a first and/or a second design element, one of the design elements is shifted inwardly.

The invention contemplates that any suitable material may be used to fabricate the base element of the invention, including, without limitation, natural or artificial gold, silver, platinum, copper, nickel, titanium, palladium, rhodium, tungsten, iridium, cobalt, ruthenium, niobium, osmium, zirconium, rhenium, wood, plastic, other natural or artificial materials, or combinations thereof.

Design elements that may be used in the invention comprise ornamental stones of any size and shape and may include, without limitation, natural or artificial agate, amethyst, aquamarine, beryl, bloodstone, carnelian, citrine, diamond, emerald, onyx, opal, garnet, lolite, lapis lazuli, onyx, opal, pearl, peridot, quartz, ruby, sapphire, turquoise, topaz, tanzanite, tourmaline, any other stone, mineral, or jewel.

Alternatively, the design elements may be comprised of decorative elements fabricated from the same material as the base element or from a different material that aesthetically complements or contrasts with the base element.

While specific embodiments have been described in detail, it will be appreciated by those skilled in the art that various modifications and alternatives to those details could be developed in light of the overall teachings of the disclosure. Accordingly, the particular embodiments disclosed are meant to be illustrative only and not limiting as to the scope of the customized jewelry design described herein, which is to be given the full breadth of the appended claims and any and all equivalents thereof.

What is claimed is:

1. A method of custom designing a jewelry article to commemorate a special date, the method comprising:

(a) selecting at least one day, from numbers 1 through 31, and at least one month, from numbers 1 through 12;

(b) placing a zero reference point temporarily or permanently on a base element;

(c) placing at least one first design element which corresponds to the at least one selected day on the base element, wherein the placement of the at least one first design element is determined by degrees of clockwise rotation from the zero reference point, said degrees of rotation calculated by the equation: minute hand degrees of rotation from zero reference point=day number×6 degrees; and (d) placing at least one second design element which corresponds to the at least one selected month on the base element, wherein the placement of the at least one second design element is determined by degrees of clockwise rotation from the zero reference point, said degrees of rotation calculated by the equation: hour hand degrees of rotation from zero reference point=(month number×30 degrees)+(day number×0.5 degrees).

2. The method of claim 1, wherein the first design element and the second design element comprises two or more ornamental stones adjacent to one another.

3. The method of claim 1, wherein the base element has a front surface, a back surface, an outer surface, and an inner surface, wherein the at least one first design element and the at least one second design element are positioned on the front surface of the base element.

4. The method of claim 1, wherein the base element has a shape selected from circular, ovoid, elliptical, rectangular, square, multi-sided and irregular shaped.

5. The method of claim 1, wherein the base element is a solid that is a closed loop, an open loop, a flat plane, or three-dimensional.

6. The method claim 1, wherein the base element comprises natural or artificial gold, silver, platinum, copper, nickel, titanium, palladium rhodium, tungsten, iridium, cobalt, ruthenium, niobium, osmium, zirconium, rhenium, wood, plastic, other natural or artificial materials, or combinations thereof.

7. The method of claim 1, wherein the at least one first and one second design element comprise an ornamental stone comprising natural or artificial agate, amethyst, aquamarine, beryl, bloodstone, carnelian, citrine, diamond, emerald, onyx, opal, garnet, lolite, lapis lazuli, onyx, opal, pearl, peridot, quartz, ruby, sapphire, turquoise, topaz, tanzanite, tourmaline, any other stone, mineral, or jewel and combinations thereof.

8. The method of claim 1, wherein the at least one first and one second design element comprise decorative elements fabricated from the same material as the base element or from a different material that aesthetically complements or contrasts with the base element material.

9. The method of claim 1, wherein the base element is configured as a pendant or a pair of earrings.

10. The method of claim 1, wherein the base element has a front surface, a back surface, an outer surface, and an inner surface, wherein the at least one first design element and the at least one second design element are positioned on the outer surface of the base element.

11. The method of claim 10, wherein the shape of the base element is selected from circular, ovoid, elliptical, rectangular, square, multi-sided, and irregular shaped.

12. The method of claim 10, wherein the base element comprises a solid that is an open loop, a flat plane, or is three-dimensional.

13. The method of claim 10, wherein the outer surface and the inner surface of the base element is greater in width than the width of the front surface and the back surface.

14. The method of claim 10, wherein the outer surface and the inner surface of the base element is between about 3 to about 4 times greater in width than the width of the front surface and the back surface.

15. The method of claim 10, wherein the base element comprises natural or artificial gold, silver, platinum, copper, nickel, titanium, palladium rhodium, tungsten, iridium, cobalt, ruthenium, niobium, osmium, zirconium, rhenium, wood, plastic and other natural or artificial materials, and combinations thereof.

16. The method of claim 10, wherein the one first and one second design element comprise an ornamental stone comprising natural or artificial agate, amethyst, aquamarine, beryl, bloodstone, carnelian, citrine, diamond, emerald, onyx, opal, garnet, lolite, lapis lazuli, onyx, opal, pearl, peridot, quartz, ruby, sapphire, turquoise, topaz, tanzanite, tourmaline, any other stone, mineral or jewel and combinations thereof.

17. The method of claim 10, wherein the one first and one second design element comprise decorative elements fabricated from the same material as the base element or from a different material that aesthetically complements or contrasts with the base element material.

18. The method of claim 10, wherein the base element is configured as a ring or a bracelet.

* * * * *